US006796279B1

(12) United States Patent
Aiken

(10) Patent No.: US 6,796,279 B1
(45) Date of Patent: Sep. 28, 2004

(54) SYSTEM AND METHOD TO PREVENT ACCIDENTAL STARTING OF A MOTOR DURING REPAIR OR MAINTENANCE

(76) Inventor: Thomas D. Aiken, 68 Walnut Cir., Basking Ridge, NJ (US) 07920

( * ) Notice: Subject to any disclaimer, the term of this patent is extended or adjusted under 35 U.S.C. 154(b) by 0 days.

(21) Appl. No.: 10/401,050

(22) Filed: Mar. 27, 2003

Related U.S. Application Data

(60) Provisional application No. 60/367,862, filed on Mar. 27, 2002.

(51) Int. Cl.[7] ..... F02P 11/00; H01R 13/44

(52) U.S. Cl. ..... 123/169 PA; 123/198 D; 174/5 R; 174/138 F; 439/148

(58) Field of Search ..... 123/143 C, 169 R, 123/169 PA, 169 PH, 198 D, 198 DC; 174/5 R, 138 F; 439/125, 148

(56) References Cited

U.S. PATENT DOCUMENTS 794,140 A * 7/1905 Costa ..... 439/148
2,736,153 A * 2/1956 Dunn ..... 123/146.5 R
5,096,430 A * 3/1992 D'Amico ..... 439/148
5,106,314 A * 4/1992 Bael ..... 439/148
5,571,995 A * 11/1996 Pierce ..... 439/148
5,797,298 A * 8/1998 Grevel ..... 439/148
5,824,948 A * 10/1998 Berg ..... 174/5 R
5,982,266 A * 11/1999 Sanford et al. ..... 337/168
2003/0156412 A1 * 8/2003 Limber et al. ..... 362/249

* cited by examiner

*Primary Examiner*—Tony M. Argenbright
(74) *Attorney, Agent, or Firm*—Mathews, Collins, Shepherd & McKay, P.A.

(57) ABSTRACT

A method and system to prevent the accidental reattachment of a spark plug wire or battery terminal wire during maintenance and/or repair of the motor is particularly well suited for use with small 2 and 4 stroke internal combustion engines used in lawn mowers, chain saws, gardening equipment, etc. Once the wire is detached from the spark plug or battery terminal, the a non-wired ("dummy") boot is snapped over the spark plug or battery terminal thereby preventing accidental contact of the wire to the spark plug or battery terminal due to the memory of the wire.

20 Claims, 3 Drawing Sheets

SYSTEM AND METHOD TO PREVENT ACCIDENTAL STARTING OF A MOTOR DURING REPAIR OR MAINTENANCE

CROSS REFERENCES TO RELATED APPLICATIONS

This application claims the benefit under 35 U.S.C. 119(e) of U.S. Provisional Application Ser. No. 60/367,862, entitled System And Method To Prevent Accidental Starting Of A Motor During Repair Or Maintenance, filed on Mar. 27, 2002.

FIELD OF INVENTION

The present invention relates a business method and system for preventing accidental starting of a motor during repair or maintenance.

BACKGROUND OF THE INVENTION

A danger encountered when working to repair or performing maintenance on an internal combustion engine or electrical motor is the accidental starting of the engine or motor. With outdoor power equipment having both 2 stroke and 4 stroke internal combustion motors it is recommended that the spark plug wire be disconnected from the spark plug prior to the operator engaging in activity around the engine to prevent accidental start-up of the engine. Such activities might include cleaning, repairing, dislodging foreign material, overhauling, inspecting or general maintenance. A cautionary statement to this effect often appears in the equipment owner's manual.

When working with a battery-powered electric motor, it is recommended to disconnect at least one of the battery terminal leads. This safety procedure is often described in the equipment owner's manual.

Spark plug wires and battery terminal wires exhibit a memory behavior, wherein they tend to return to the installed position on their own. Therefore there is a need to prevent the accidental reattachment of a spark plug wire or battery terminal wire during maintenance and repair of the engine or motor.

SUMMARY OF THE INVENTION

The present invention is a business method and system to prevent the accidental reattachment of a spark plug wire or battery terminal wire during maintenance and/or repair of the motor (electrical or internal combustion).

BRIEF DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

Figure 1:
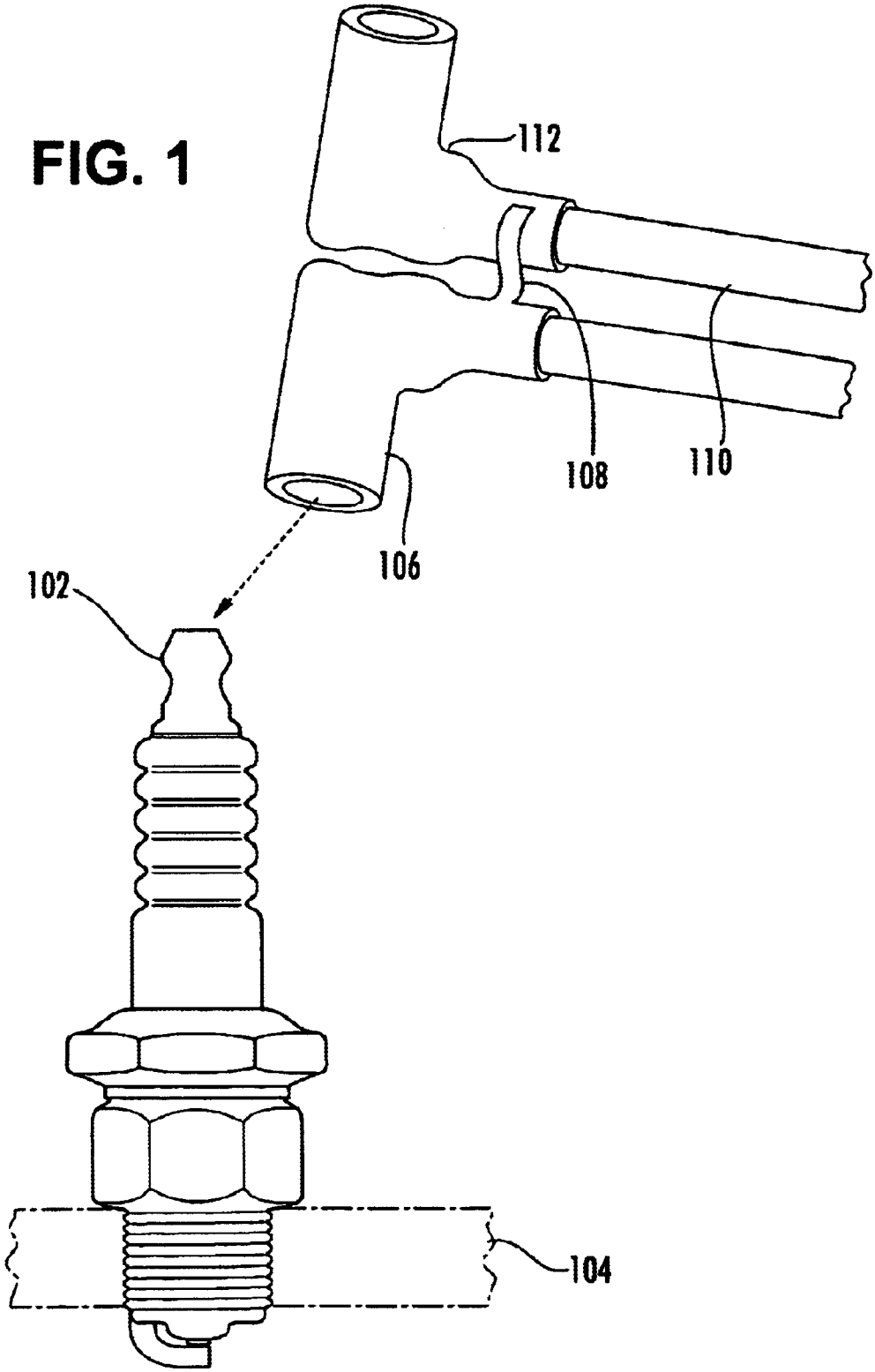
FIG. 1 is a representation of a dummy boot and a typical spark plug.

While, the present invention business method and system to prevent the accidental reattachment of a spark plug wire or battery terminal wire during maintenance and/or repair of the motor is particularly well suited for use with small 2 and 4 stroke internal combustion engines used in lawn mowers, chain saws, gardening equipment, etc. and shall be so described herein, it is equally well suited for use with battery powered electric motors and other motors/engines which have an electrical connection necessary for operation.

The National Safety Council (NSC) keeps track of injuries in the United States by injury type each year. The United States Consumer Product Safety Commission's National Electronic Injury Surveillance System (NEISS) provides this injury data to the NSC. NEISS estimates are calculated using a statistically representative sample of hospitals in the United States. Injury totals represent estimates of the number of hospital emergency department-treated cases associated with various products. For example, in 1998, NSC citing NEISS data, reports the following injury counts for select yard and garden equipment: lawn mowers—76,237; pruning, trimming edging equipment—39,651; and chainsaws—33,158. While, the causes of these injuries were not reported a number of them are related to accidental engine startup. Additionally, the NEISS data makes no distinction is made between internal combustible engine and electric motor powered equipment.

In addition to the obvious damage caused to the operator, the injuries are problematic for the manufacturers as the result of liability, legal defense and insurance expenses and loss of sales through negative publicity. A system or method, which can prevent the accidental reattachment of a spark plug wire or battery terminal wire during maintenance and repair of the engine and/or motor will provide a manufacturer with reduced expenses and the potential for significant positive publicity.

A frequent danger encountered when working with an internal combustion engine or electrical motor is the accidental starting of the engine or motor and resulting injury to the technician/operator. With outdoor power equipment having internal combustion engines it is recommended that the spark plug wire be disconnected from the spark plug prior to the operator engaging in activity around the engine to prevent accidental start-up of the engine. Such activities might include cleaning, repairing, dislodging foreign material, overhauling, inspecting or general maintenance. Typically an explicit cautionary statement to this effect appears in the equipment owner's manual. When working with a battery powered motor, for lawn and gardening equipment, scooters, electric wheel chairs, etc. it is recommended to disconnect one of the battery terminal leads, which is typically described in the equipment owner's manual.

Disconnecting the spark plug as recommended in some operators' manuals while an effective means of ensuring safety when working with the engine, gives a false sense of security. Manufacturers recommend that the operator disconnect the ignition wire at the terminal, which connects directly to the terminal end of the spark plug. This end of the ignition wire is encased in an angle boot insulator.

Removing the spark plug boot, which typically is an angle shaped boot insulator, from the spark plug will prevent the accidental engine startup as described above. If, for instance, a lawn mower blade were to become entangled with rope and the operator were to attempt to remove the rope without disconnecting the spark plug, any rotary action applied to the blade could generate sufficient energy to create a spark, which would engage the motor that would spin the blade at normal operating speed. A hand or foot caught under the deck of the mower would be seriously injured. However, with the ignition wire disconnected it will remember its previous position due to its stiff composition. This memory results in the wire attempting to move back into its original operating position and may once again coming in contact with the spark plug terminal, thereby completing the circuit and creating the dangerous potential for a spark and engine start-up.

Obviously, simply removing the spark plug wire or battery cable provides a very dangerous false sense of security as spark plug wires and battery terminal wires exhibit a memory behavior, wherein they tend to return to their installed position on their own. When the memory behavior results in the unintended reattachment of a spark plug wire or battery terminal wire during maintenance and repair of the engine or motor, the technician/operator is placed in a position of potential serious injury.

Referring to FIG. 1 there is shown a representative embodiment of the present invention. A typical spark plug 102 is mounted in an engine block 104 (shown in a partial cross section). A non-wired boot insulator 106 ("dummy" boot), is attached by clip 108 to the functional boot 112 which is connected to high-tension wire 110. For easy and rapid identification the dummy boot 106 and the functional boot 112 are color-coded. Once the high-tension (ignition) wire 110 is detached from the spark plug 102 at the wired boot end 112, the non-wired boot 106 is snapped over the spark plug 102 thereby preventing accidental contact of the functional boot 112 to the spark plug 102 terminal due to the memory of the ignition wire 110.

In another embodiment of the present invention, the dummy boot has the following configurations:

- unique shape similar to the wired boot but different enough so as not to be confused with the wired boot and with an opening to accept the solid post terminal of the spark plug;
- able to snap easily but securely over the outer diameter of standard power equipment spark plug terminals (d=0.248 inch);
- made of commercially available, non-conducting, heat-resistant material; and
- vividly colored to remind the user of its purpose and importance as an effective safety device and to distinguish it further from the wired boot.

In one embodiment of the present invention, the original equipment manufacturer produces a two-terminal ignition wire, one being electronically active, and the other inactive (the dummy boot). This ensures location near the spark plug thereby enhancing the likelihood of use by the operator. In addition, the original equipment manufacturer can provide the retail market with an attachable non-wired boot for equipment currently in the market. The attachable, retro-fitted dummy boot 106 can clip on to the ignition wire 110 or the functional boot 112 with a c-shaped snap clip 108, be attached with an adhesive to the functional boot, as well as be attached with a variety of different configurations which would be known to those skilled in the art.

The Society of Automotive Engineers (SAE) maintains a technical standards board that sets rules and guidelines to advance the state of technical and engineering sciences. SAE's publication J548-1, revised March 2000, represents the Surface Vehicle Standard for spark plugs. Described in the publication are dimensional standards for the most common spark plug for combustible engine outdoor equipment, known as the Bantam Solid Post Type. Bantam plugs are shorter to reduce packaging dimensions of the finished equipment, making them suitable for typical consumer products. The configuration and dimensions of the non-wired or dummy boot would therefore be fairly standardized for U.S. power equipment.

In another embodiment of the present invention, such as used with a retro-fitted kit, the interior of the dummy boot is a pliable spongy material, enabling its use with a variety of spark plug types.

Figure 2:
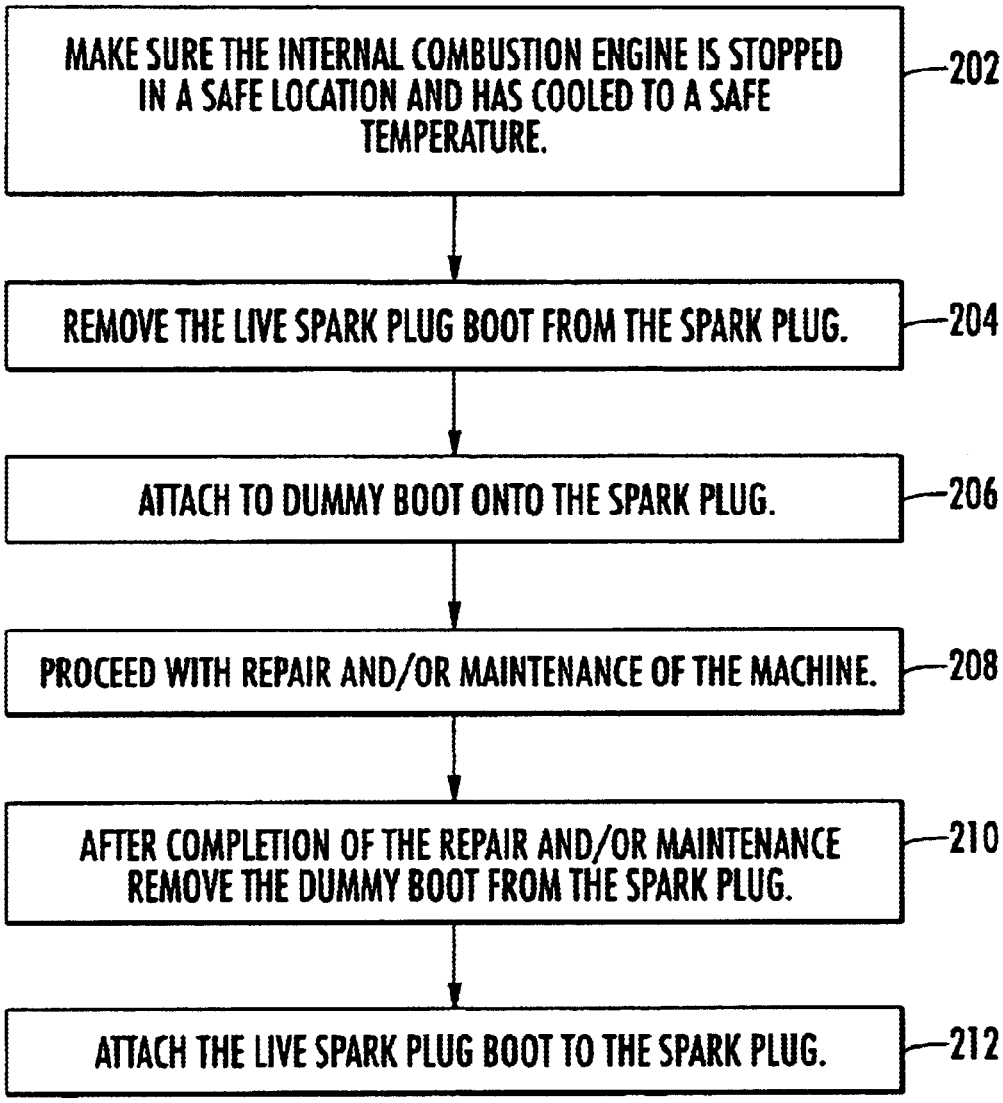
FIG. 2 is a flow chart of the steps to prevent the accidental reattachment of a spark plug wire during maintenance and/or repair of an internal combustion engine; and, FIG. 3 is a flow chart of the steps method to prevent the accidental reattachment of a battery terminal wire during maintenance and/or repair of an electric motor.

The steps for the present invention method to prevent the accidental reattachment of a spark plug wire during maintenance and/or repair of an internal combustion engine are shown in FIG. 2. Starting with step 202 the individual makes sure the internal combustion engine is stopped in a safe location and has cooled to a safe temperature. In step 204, they remove the live spark plug boot from the spark plug, which is followed by step 206 wherein they attach to dummy boot onto the spark plug. In step 208 they now proceed with repair and/or maintenance of the machine. After completion of the repair and/or maintenance in step 210 they remove the dummy boot from the spark plug and attach the live spark plug boot to the spark plug in step 212.

Figure 3:
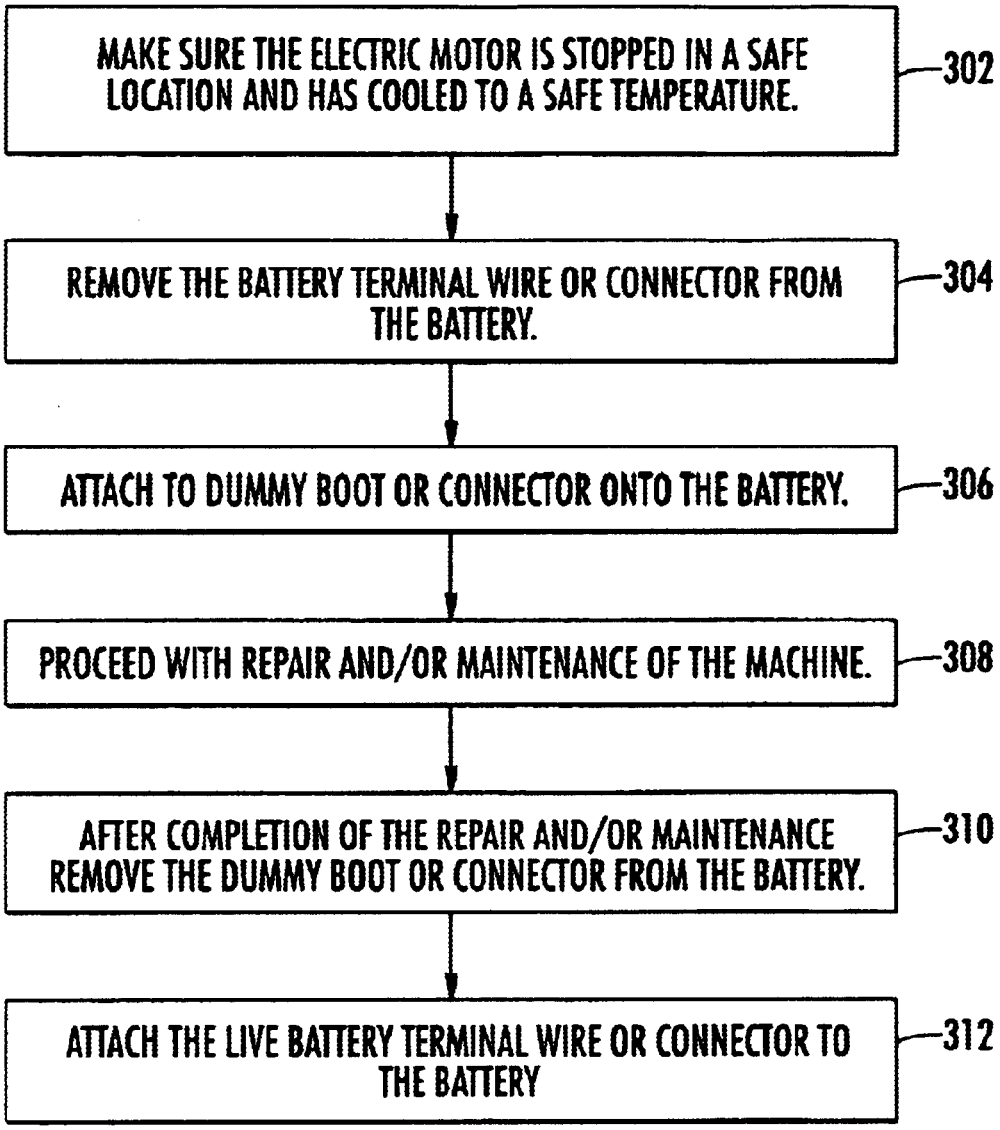

The steps for the present invention method to prevent the accidental reattachment of a battery terminal wire spark plug wire during maintenance and/or repair of an electric motor are shown in FIG. 3. Starting with step 302 the individual makes sure the electric motor is stopped in a safe location and has cooled to a safe temperature. Then in step 304 they remove the battery terminal wire or connector from the battery and then in step 306 they attach to dummy boot or connector onto the battery. Now in step 308 they can proceed with repair and/or maintenance of the machine. After completion of the repair and/or maintenance in step 310 they remove the dummy boot or connector from the battery and attach the live battery terminal wire or connector to the battery in step 312.

Numerous modifications and alternative embodiments of the invention will be apparent to those skilled in the art in view of the foregoing description. In particular, a dummy battery terminal can be used with an electric motor. The details of the dummy battery terminal are dependent on the type and configuration of the live battery terminal, which includes clamp or bolt on terminals, snap on and push on terminals as well a variety of other terminals known to those skilled in the art. A clip may be used to secure the wire directly to the sparkplug or terminal. Accordingly, this description is to be construed as illustrative only and is for the purpose of teaching those skilled in the art the best mode of carrying out the invention. Details of the structure may be varied substantially without departing from the spirit of the invention and the exclusive use of all modifications, which come within the scope of the appended claims, is reserved.

What is claimed:

1. A method for preventing accidental starting of an internal combustion motor having a spark plug during repair or maintenance comprises the steps of:

removing a functional spark plug boot from the spark plug having a conducting terminal;

attaching a dummy boot onto the spark plug thereby covering the conducting terminal; and, proceeding with work;

wherein the dummy boot prevents accidental contact of the functional spark plug boot with the conducting terminal of the spark plug to prevent accidental starting of the internal combustion motor.

2. The method as recited in claim 1 further comprising the steps of:

removing the dummy boot after completion of the work on the internal combustion motor; and, attaching the functional spark plug boot to the spark plug.

3. The method as recited in claim 1 further comprising the step of identifying the dummy boot by color.

4. The method as recited in claim 1 further comprising the step of identifying the dummy boot by shape.

5. A method for preventing accidental starting of electrical motor powered by a battery having a first terminal and a second terminal, the method comprises the steps of:

disconnecting a conductor from the first terminal of the battery;

attaching a dummy boot to the first terminal of the battery;

proceeding with work wherein the dummy boot prevents accidental contact of the conductor with the first terminal of the battery to prevent accidental starting of the electrical motor.

6. The method as recited in claim 5 further comprising the steps of:

removing the dummy boot after completion of the work; and, attaching the battery terminal wire or connector to the battery.

7. The method as recited in claim 5 further comprising the step of identifying the dummy boot by color.

8. The method as recited in claim 5 further comprising the step of identifying the dummy boot by shape.

9. A system for preventing accidental starting of an internal combustion motor having a spark plug with a conducting terminal during repair or maintenance, the system comprising:

a dummy boot attached near a functional spark plug boot, the dummy boot being electrically insolated from high-tension wiring of the internal combustion motor;

wherein attaching the dummy boot onto the spark plug in place of the functional spark plug boot covers the conducting terminal of the spark plug and thereby prevents accidental contact of the functional spark plug boot with the conducting terminal of the spark plug to prevent accidental starting of the internal combustion motor.

10. The system as recited in claim 9 wherein the dummy boot has a different color than the functional spark plug boot.

11. The system as recited in claim 9 wherein the dummy boot has a different shape than the functional spark plug boot.

12. The system as recited in claim 9 wherein the dummy boot is attached to the high-tension wiring near the functional spark plug boot.

13. The system as recited in claim 9 wherein the dummy boot is attached to the functional spark plug boot.

14. The system as recited in claim 12 wherein the dummy boot is attached to the high-tension wiring near the functional spark plug boot with a clip.

15. The system as recited in claim 13 wherein the dummy boot is attached to the functional spark plug boot with a clip.

16. A system for preventing accidental starting of electrical motor powered by a battery having a first terminal and a second terminal, the system comprising:

a dummy boot attached near a functional connector, the dummy boot being electrically insolated from the functional connector and wiring coupled to the functional connector;

wherein attaching the dummy boot to the first terminal of the battery in place of the functional connector covers the first terminal of the battery and thereby prevents accidental contact of the functional connector with the first terminal of the battery to prevent accidental starting of the electrical motor.

17. The system as recited in claim 16 wherein the dummy boot has a different color than the functional connector.

18. The system as recited in claim 16 wherein the dummy boot has a different shape than the functional connector.

19. The system as recited in claim 16 wherein the dummy boot is attached to the wiring near the functional connector.

20. The system as recited in claim 16 wherein the dummy boot is attached to the functional connector.

* * * * *